US005735703A

United States Patent [19]

Ballard

[11] Patent Number: 5,735,703

[45] Date of Patent: Apr. 7, 1998

[54] RECESSED BUSHING STYLE LUMINOUS TUBE TRANSFORMER FEATURING VERSATILE MOUNTING CONFIGURATION

[75] Inventor: Gerald L. Ballard, Brandon, Miss.

[73] Assignee: MagneTek, Inc., Nashville, Tenn.

[21] Appl. No.: 576,222

[22] Filed: Dec. 21, 1995

[51] Int. Cl.[6] ..... H01R 33/02

[52] U.S. Cl. ..... 439/234; 439/534

[58] Field of Search ..... 439/226, 232, 439/234, 236, 534

[56] References Cited

U.S. PATENT DOCUMENTS

| | | | |
|---|---|---|---|
| 1,806,575 | 5/1931 | Ciraolo et al. | 439/234 X |
| 2,848,599 | 8/1958 | Charbonneaux | 439/234 |
| 4,434,569 | 3/1984 | Minogue . | |
| 4,511,200 | 4/1985 | Belokin, Jr. | 439/235 X |
| 5,209,674 | 5/1993 | Foster . | |
| 5,348,413 | 9/1994 | Sklar . | |
| 5,354,208 | 10/1994 | Salaski . | |

*Primary Examiner*—Khiem Nguyen

*Attorney, Agent, or Firm*—Waddey & Patterson; Mark J. Patterson

[57] ABSTRACT

A transformer enclosure design with a separate receptacle housing used for power transformers especially those used with neon lamps. The separate receptacle housing allows for multiple neon gas discharge tube mounting orientations and allows for multiple transformer mounting configurations with one enclosure design. The receptacle is used to connect the ends of a gas discharge lamp to the transformer. The receptacle housing contains a pair of recessed bushings and features a removable mounting bracket that can be mounted in several positions. Connection between the receptacle housing and the transformer housing is through flexible GTO wiring. The design allows an almost infinite number of spatial mounting orientations so that any tube orientation may be accommodated.

3 Claims, 6 Drawing Sheets

RECESSED BUSHING STYLE LUMINOUS TUBE TRANSFORMER FEATURING VERSATILE MOUNTING CONFIGURATION

BACKGROUND OF THE INVENTION

This invention relates to enclosure designs used for power transformers especially those used with neon lamps. More particularly, the invention has a novel design for a tube receptacle that allows for multiple mounting geometry's with one enclosure design. The receptacle is used to connect the ends of a gas discharge lamp to the transformer.

Neon gas discharge lamps are frequently used for sign lighting in commercial retail outlets. Neon gas discharge lamps require a high voltage to ignite. The high voltage is supplied through a step up transformer. The connection of the lamp to the transformer with a recessed bushing has traditionally been built as an integral enclosure with the transformer as one unit. Recessed bushings were located so that luminous tubes would enter the enclosure via one of three orientations. FIGS. 1 and 2 show a prior art transformer assembly 30 with integral recessed bushings that has been manufactured by Magnetek. In FIG. 2, a pair of recessed bushings 31 and 32 are oriented perpendicular to an enclosure mounting base 33. The neon tube ends would engage the bushings 31 and 32 through the bottom of the transformer assembly 30. FIGS. 3,4 and 5 show another prior art transformer assembly 40 by Magnetek with integral recessed bushings. In FIG. 3, a pair of recessed bushings 41 and 42 are oriented perpendicular to an enclosure cover 43. The neon tube ends would engage the bushings 41 and 42 through the top of the transformer assembly 40. FIGS. 6,7,8 and 9 shows another prior art transformer assembly 50 by Magnetek with integral recessed bushings. In FIG. 6, a pair of recessed bushings 51 and 52 are oriented perpendicular to an end of the enclosure housing 53. The neon tube ends would engage the bushings 51 and 52 through one end of the transformer assembly 50. Thus in the prior art, the mounting location of the transformer is limited by the location of the neon tube. These three prior art recessed bushing transformer styles have several disadvantages. First, demand may be low for some configurations such that manufacturing costs are prohibitive with special tooling costs having to be amortized over a very low volume. Second, three different transformers are required at each electrical rating to be held in inventory to cover all applications resulting in high inventory costs with low turnover. Third, Enclosure sizes and mounting configurations vary from manufacturer to manufacturer resulting in installation problems when transformers are required to be replaced in existing field installations.

Other attempts at connecting to neon tubes are shown in U.S. Pat. No. 4,434,569 to Minogue, U.S. Pat. No. 5,209,674 to Foster, U.S. Pat. No. 5,348,413 to Sklar and U.S. Pat. No. 5,354,208 to Salaski. Each of these approaches shows connection to a neon tube separate from any ballast assembly.

A currently unmet need exists for a simple transformer receptacle design which can be easily manufactured, allows for multiple neon gas discharge tube mounting orientations and allows for multiple transformer mounting configurations.

SUMMARY

A transformer enclosure assembly for holding a transformer and providing power connections between a gas discharge lamp and at least one input terminal includes a transformer housing, a receptacle housing and a pair of wires connecting the transformer housing to the receptacle housing such that the receptacle housing can be positioned to have a plurality of orientations. The orientations of the receptacle housing being independent of the orientation of the transformer housing. The receptacle housing has a pair of recessed bushings for receiving the gas discharge lamp and a receptacle mounting bracket, the receptacle housing has a plurality of locations for attaching the receptacle mounting bracket. The transformer housing includes a chase nipple, which has a threaded section for connecting to an external conduit and at least one transformer mounting bracket.

BRIEF DESCRIPTION OF THE DRAWINGS

These and other features, aspects and advantages of the present invention will become better understood with regard to the following description, appended claims and accompanying drawings.

DETAILED DESCRIPTION OF THE PREFERRED EMBODIMENTS

Figure 1:
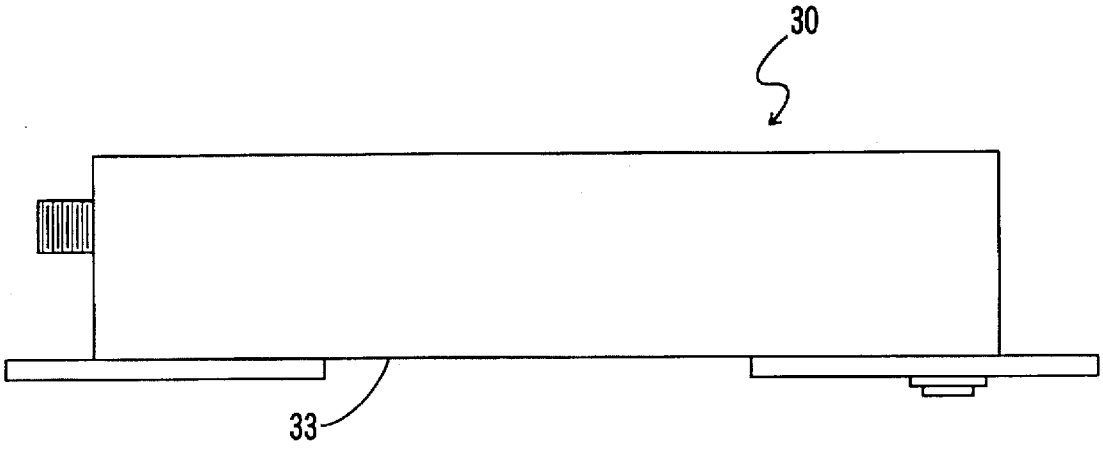
FIG. 1 (PRIOR ART)
FIG. 1 is a side view of a prior art recessed bushing transformer where the recessed bushings are mounted on the bottom of the mounting bracket.
Figure 2:
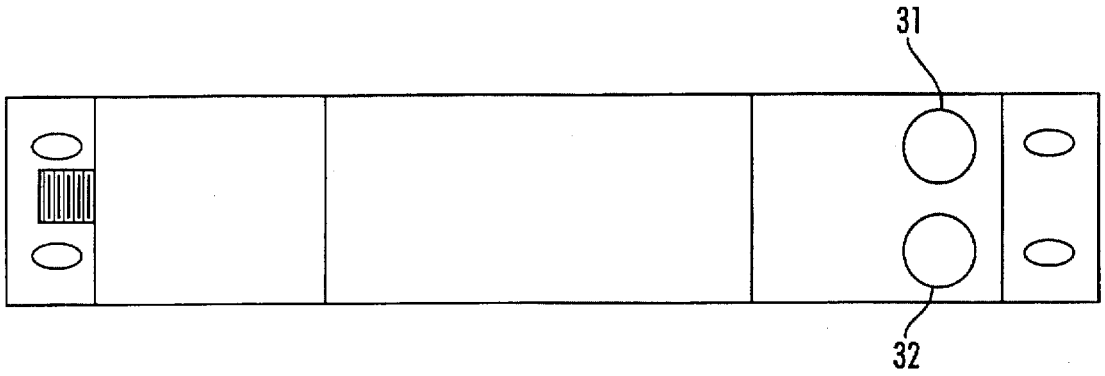
FIG. 2 (PRIOR ART)
FIG. 2 is a bottom view of the transformer of FIG. 1.
Figure 3:
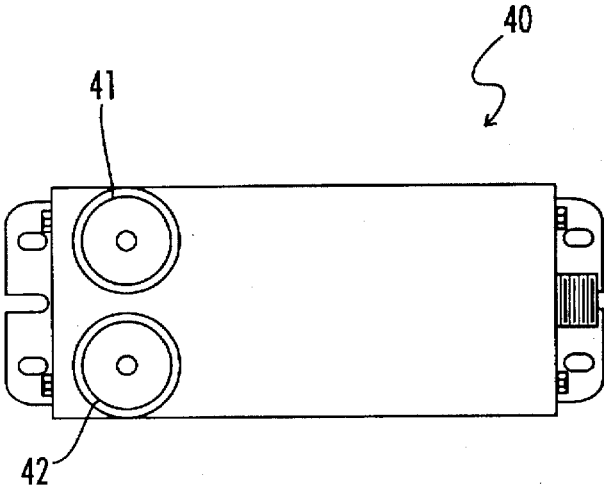
FIG. 3 (PRIOR ART)
FIG. 3 is a top view of a prior art recessed bushing transformer where the recessed bushings are mounted on the top of the enclosure cover.
Figure 4:
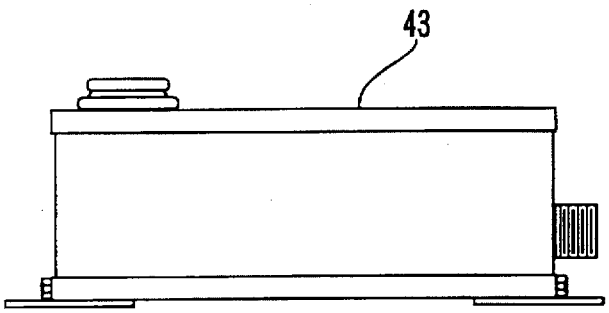
FIG. 4 (PRIOR ART)
FIG. 4 is a side view of the transformer of FIG. 3.
Figure 5:
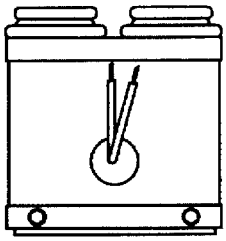
FIG. 5 (PRIOR ART)
FIG. 5 is a end view of the transformer of FIG. 3.
Figure 6:
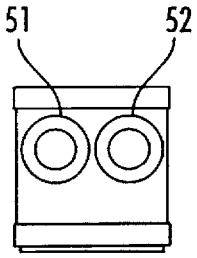
FIG. 6 (PRIOR ART)
FIG. 6 is a end view of a prior an recessed bushing transformer where the recessed bushings are mounted on the end of the transformer housing.
Figure 7:
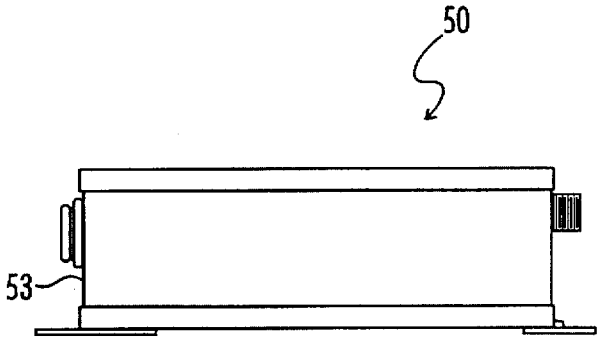
FIG. 7 (PRIOR ART)
FIG. 7 is a side view of the transformer of FIG. 6.
Figure 8:
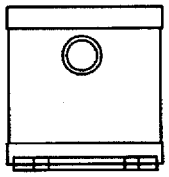
FIG. 8 (PRIOR ART)
FIG. 8 is a view of the other end of the transformer of FIG. 6.
Figure 9:
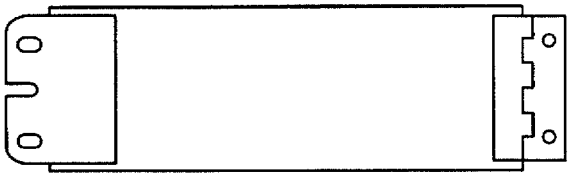
FIG. 9 (PRIOR ART)
FIG. 9 is a bottom view of the transformer of FIG. 6.
Figure 10:
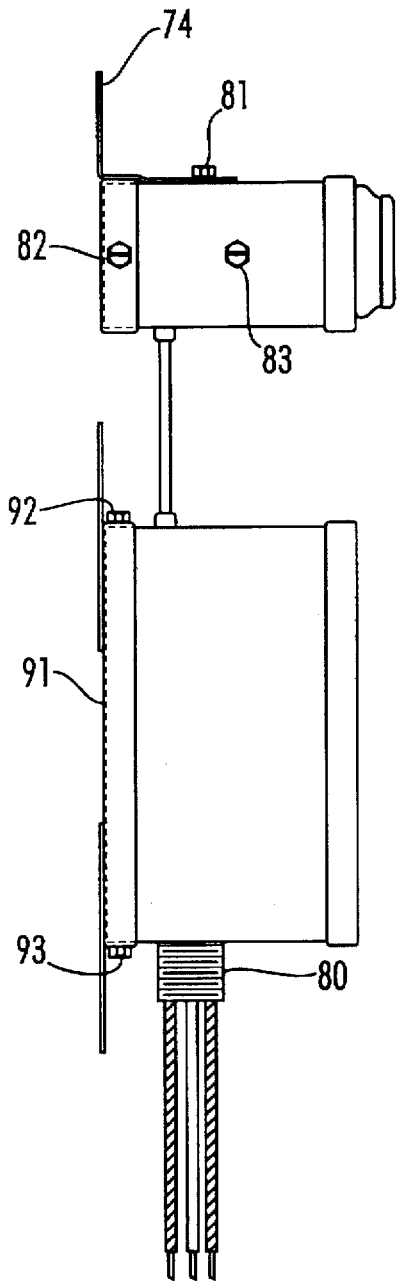
FIG. 10 is a side view of a first embodiment of the present invention showing a extended mount transformer assembly with a versatile recessed bushing receptacle.
Figure 11:
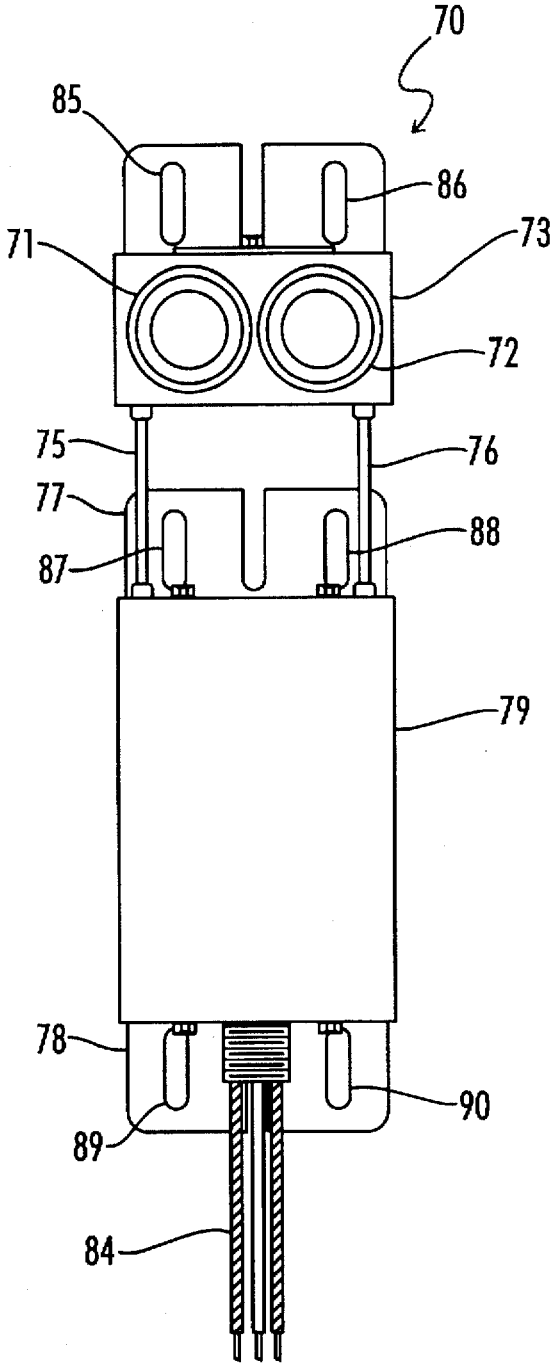
FIG. 11 is a top view of the transformer assembly of FIG. 10.

A first embodiment of the present invention is shown in FIGS. 10, and 11. This first embodiment is an extended mount style in which the recessed bushing receptacles are located at a distance from the transformer housing. FIG. 11 shows transformer assembly 70 having a receptacle housing 73. Located within receptacle housing 73 are recessed bushings 71 and 72. Recessed bushings 71 and 72 accept the ends of a gas discharge lamp in order to mechanically hold and electrically connect the transformer to the lamp.

Attached to the receptacle housing 73 is a receptacle mounting bracket 74 which attaches in a multiple of orientations depending on if it is attached with receptacle mounting bracket screw 81, 82 or 83. Receptacle mounting bracket 74 has slotted holes 85 and 86 for attaching the receptacle housing to a light or sign fixture. The receptacle housing 73 is electrically connected to a transformer through GTO wires 75 and 76. These GTO wires are highly insulated wires required to withstand the high voltages up to 15000 volts needed for neon gas discharge lamps. Transformer housing 79 contains a transformer(not shown) that would drive the gas discharge lamps. The GTO wires run between the receptacle housing and the transformer housing. The transformer housing 79 has a cover 91 that is held in place with screws 92 and 93. Transformer housing 79 has transformer mounting brackets 77 and 78. Transformer mounting bracket 77 has slotted holes 87 and 88. Transformer mounting bracket 78 has slotted holes 89 and 90. These brackets attach the transformer housing to a light or sign fixture. A chase nipple 80 is affixed to the transformer housing through which a multiple of transformer input wires 84 pass. The chase nipple has threads for connection to conduit in which the input wires would be contained.

Figure 12:
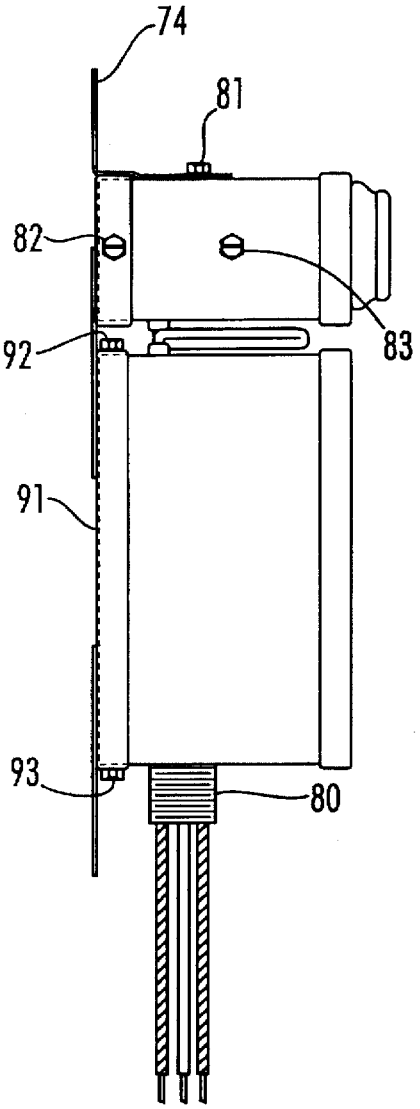
FIG. 12 is a side view of a second embodiment of the present invention showing a compact mount transformer assembly with a versatile recessed bushing receptacle.
Figure 13:
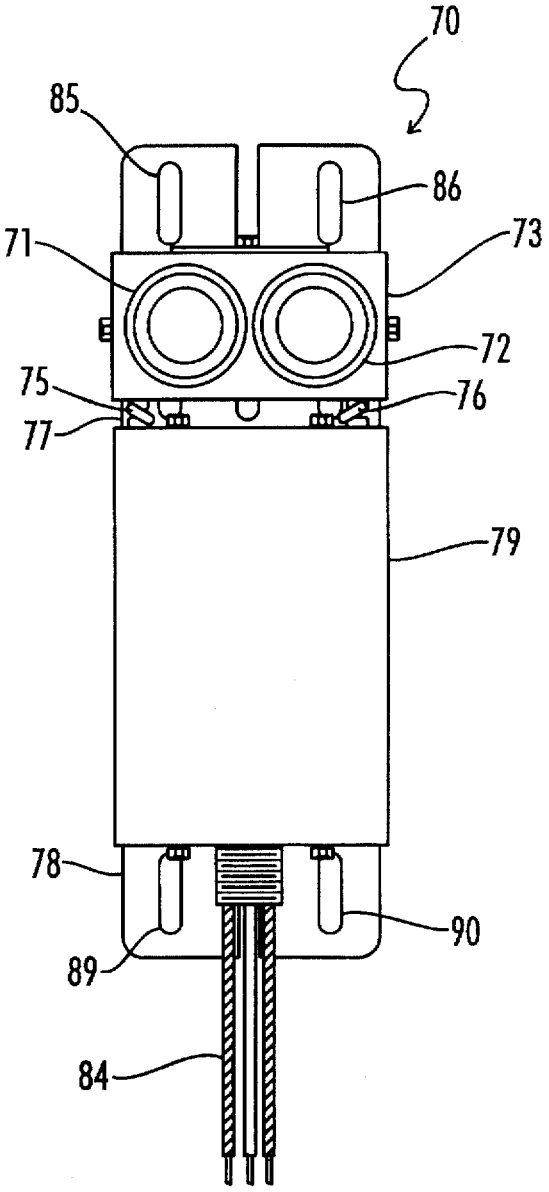
FIG. 13 is a top view of the transformer assembly of FIG. 12.
Figure 14:
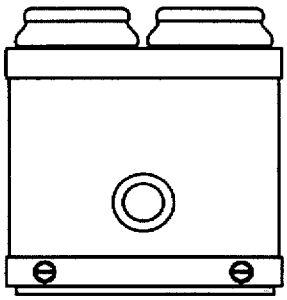
FIG. 14 is a end view of the transformer assembly of FIG. 12.

Referring to now to FIGS. 12, 13 and 14, a schematic diagram of a second embodiment of a transformer with a versatile mounting configuration is shown. This embodiment shows a compact mount style for applications in which the recessed bushing receptacles are located in close proximity to the transformer housing. The components present are identical to the version shown in FIGS. 10 and 11. The only difference is the GTO wires are made shorter so that the receptacle housing 70 is adjacent to the transformer housing 79.

Figure 15:
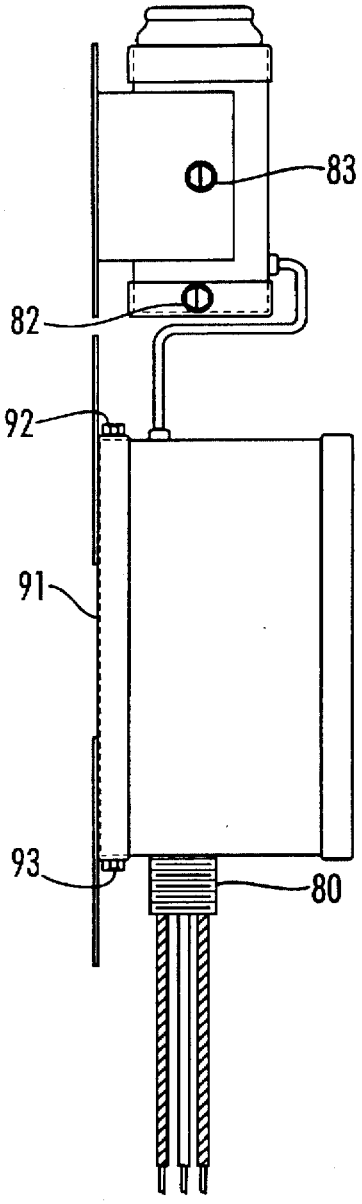
FIG. 15 is a side view of a third embodiment of the present invention showing a in-line mount transformer assembly with a versatile recessed bushing receptacle.
Figure 16:
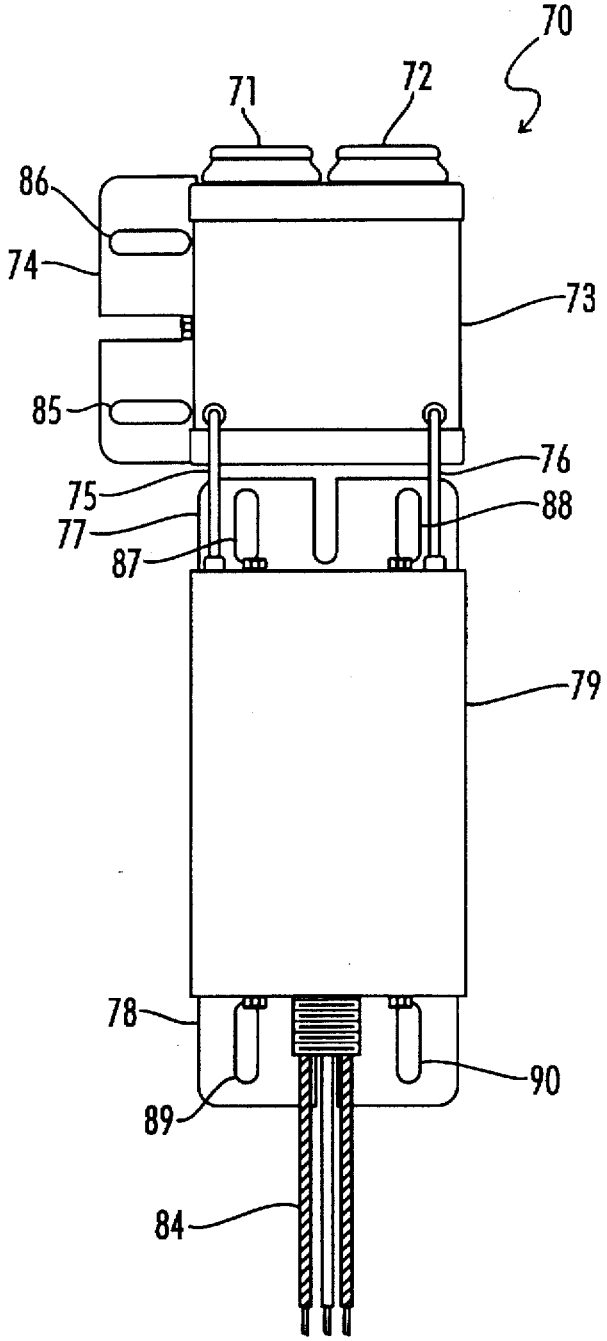
FIG. 16 is a top view of the transformer assembly of FIG. 15.

Referring to now to FIGS. 15 and 16, a schematic diagram of a third embodiment of a transformer with a versatile mounting configuration is shown. This embodiment shows a in-line style mount for applications in which the recessed bushing receptacles are oriented to accept the ends of the gas discharge lamps in the same axis as the end orientation of the transformer housing. The components present are identical to the version shown in FIGS. 10 and 11. The only difference is the orientation of the receptacle housing 70 is changed by bending the GTO wires and the receptacle mounting bracket position has been changed from being held by screw 81 to being held by screw 83.

In the construction of the present invention, the transformer housing utilizes a smaller than average size that features a standard chase nipple for the primary voltage connection. The transformer housing has GTO wires exiting it instead of a recessed bushing. The receptacle housing contains the recessed bushings and features a removable mounting bracket that can be mounted in several positions. The flexible GTO wires plus the mounting bracket allows an almost infinite number of spatial mounting orientations so hat any tubing orientation may be accommodated. The flexibility afforded by the small size of the housings will allow for the design to easily retrofit to other manufacturers mounting footprints. The flexible connection between the transformer housing and the receptacle housing can permit novel product applications that previously were not possible with the rigid enclosures of the prior art.

The present invention has been described in connection with a preferred embodiment. It will be understood that many modifications and variations will be readily apparent to those of ordinary skill in the art without departing from the spirit or scope of the invention and that the invention is not to be taken as limited to all of the details herein. Therefore, it is manifestly intended that this invention be limited only by the claims and the equivalents thereof.

What is claimed is:

1. A transformer enclosure assembly for holding a transformer and providing power connections between a gas discharge lamp and at least one input terminal comprising:

a transformer housing;

a receptacle housing;

a pair of recessed bushings mounted within the receptacle housing for receiving the gas discharge lamp;

a receptacle mounting bracket attached to the receptacle housing, the receptacle housing having a plurality of locations for attaching the receptacle mounting bracket; and a pair of wires connecting the transformer housing to the receptacle housing such that the receptacle housing can be positioned to have a plurality of orientations, the orientations of the receptacle housing being independent of the orientation of the transformer housing.

2. The transform closure assembly according to claim 1, wherein the transformer housing further comprises a chase nipple, the chase nipple having a threaded section for connecting to an external conduit.

3. The transformer enclosure assembly according to claim 1, wherein the transformer housing further comprises at least one transformer mounting bracket.

* * * * *